US012601287B2

(12) United States Patent
Chennagowni et al.

(10) Patent No.: US 12,601,287 B2
(45) Date of Patent: Apr. 14, 2026

(54) INTERNAL COMBUSTION ENGINE WITH IMPROVED COOLANT FLOW DISTRIBUTION

(71) Applicant: Caterpillar Inc., Peoria, IL (US)

(72) Inventors: Suresh Babu Chennagowni, Peoria, IL (US); Mandar A. Joshi, Dunlap, IL (US); Siyi Zhou, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 263 days.

(21) Appl. No.: 18/234,488

(22) Filed: Aug. 16, 2023

(65) Prior Publication Data

US 2025/0059904 A1 Feb. 20, 2025

(51) Int. Cl.
*F01P 3/02* (2006.01)

(52) U.S. Cl.
CPC ..... *F01P 3/02* (2013.01); *F01P 2003/028* (2013.01)

(58) Field of Classification Search
CPC ... F01P 3/02; F01P 2003/028; F01P 2003/021
See application file for complete search history.

(56) References Cited

U.S. PATENT DOCUMENTS

| | | | | |
|---|---|---|---|---|
| 4,601,265 | A * | 7/1986 | Wells | F02F 1/40 123/41.82 R |
| 6,981,473 | B2 | 1/2006 | Gunji et al. | |
| 7,234,422 | B2 | 6/2007 | Schlautman et al. | |
| 10,323,601 | B2 | 6/2019 | Zahdeh et al. | |
| 10,584,658 | B2 * | 3/2020 | Yanase | F02F 1/242 |
| 2005/0087154 | A1 * | 4/2005 | Hayman | F01N 3/043 123/41.82 R |
| 2011/0114043 | A1 * | 5/2011 | Hamakawa | F02F 1/14 123/41.74 |
| 2011/0315098 | A1 * | 12/2011 | Kosugi | F02F 1/10 123/41.74 |
| 2016/0047332 | A1 | 2/2016 | Knudsen et al. | |
| 2016/0258381 | A1 * | 9/2016 | Tempesta | F02F 1/14 |
| 2019/0345891 | A1 * | 11/2019 | Takagawa | F02F 7/00 |
| 2020/0080465 | A1 * | 3/2020 | Sugiura | F01P 3/02 |
| 2020/0248646 | A1 * | 8/2020 | Knollmayr | F02F 1/40 |

FOREIGN PATENT DOCUMENTS

| | | |
|---|---|---|
| WO | 2010035285 | 4/2010 |
| WO | 2021037783 | 3/2021 |

* cited by examiner

*Primary Examiner* — Kurt Philip Liethen
(74) *Attorney, Agent, or Firm* — Schwegman Lundberg & Woessner, P.A.

(57) ABSTRACT

Apparatuses, systems and methods are disclosed including an internal combustion engine. The internal combustion engine can include an engine block and a cylinder head. The engine block can define an inlet passage and a plurality of cylinder jackets in fluid communication in series. The engine block can include one or more passages from each of the plurality of cylinder jackets. The cylinder head can be mounted to the engine block and can include an outlet passage and a plurality of lower cylinder head jackets. The one or more passages can be in fluid communication with respective ones the plurality of lower cylinder head jackets. A diameter of the one or more passages in fluid communication with one of the plurality of cylinder jackets differs from diameters of the one or more passages in fluid communication with others of the plurality of cylinder jackets.

18 Claims, 9 Drawing Sheets

INTERNAL COMBUSTION ENGINE WITH IMPROVED COOLANT FLOW DISTRIBUTION

TECHNICAL FIELD

The present disclosure relates to an internal combustion engine. More particularly, the present disclosure relates to apparatuses, systems and methods for improving the flow of coolant within the internal combustion engine.

BACKGROUND

Machinery, for example, agricultural, industrial, construction or other heavy machinery can be propelled by an internal combustion engine(s). Internal combustion engines can be used for other purposes such as for power generation. Internal combustion engines combust a mixture of air and fuel in cylinders and thereby produce drive torque and power. Power output of internal combustion engines is continually increasing. With this increase, the requirement to cool the engine block and the cylinder head also increases. Conventional cooling systems direct coolant flow from the engine block to the cylinder head. However, the flow and pressure of the coolant can vary significantly from cylinder to cylinder within the internal combustion engine.

U.S. Pat. Nos. 7,234,422 and 10,323,601 disclose improvements to lower cylinder head jackets. However, these patents do not recognize improvement in coolant flow uniformity along the cylinders or lower cylinder head jackets and other benefits in the manner disclosed herein.

SUMMARY

In an example according to this disclosure, an internal combustion engine optionally including: an engine block defining an inlet passage and defining a plurality of cylinder jackets in fluid communication in series, wherein the engine block defines one or more passages from each of the plurality of cylinder jackets; and a cylinder head mounted to the engine block, the cylinder head defining an outlet passage and defining a plurality of lower cylinder head jackets, wherein the one or more passages are in fluid communication with respective ones the plurality of lower cylinder head jackets; wherein a diameter of the one or more passages in fluid communication with one of the plurality of cylinder jackets differs from diameters of the one or more passages in fluid communication with others of the plurality of cylinder jackets.

In another example according to this disclosure, a cooling system for an internal combustion engine optionally including: a plurality of cylinder jackets formed by an engine block, the plurality of cylinder jackets in fluid communication in series; a plurality of lower cylinder head jackets formed by a cylinder head; and a plurality of passages in fluid communication with the plurality of cylinder jackets and the plurality of lower cylinder head jackets, wherein a diameter of each of the plurality of passages in fluid communication with one of the plurality of cylinder jackets differ from diameters of the plurality of passages in fluid communication with others of the plurality of cylinder jackets.

In yet another example according to this disclosure, a method of metering coolant within between an engine block and a cylinder head of an internal combustion engine, the method optionally including: passing the coolant through an inlet of the engine block to into a first of a plurality of cylinder jackets formed by the engine block; passing the coolant in series from the first of the plurality of cylinder jackets to others of the plurality of cylinder jackets; passing the coolant from the plurality of cylinder jackets to a plurality of lower cylinder head jackets formed by the cylinder head, wherein the passing the coolant from one of the plurality of cylinder jackets to one of the plurality of lower cylinder head jackets is through larger diameter passages than the passing the coolant through passages from others of the plurality of cylinder jackets to others of the plurality of lower cylinder head jackets; and passing the coolant from an outlet of the cylinder head.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Examples of the present disclosure are now described with reference to the accompanying drawings. The following description is merely exemplary in nature and is not intended to limit the present disclosure, application, or use. Examples described set forth specific components, devices, and methods, to provide an understanding of embodiments of the present disclosure. It will be apparent to those skilled in the art that specific details need not be employed and that examples may be embodied in many different forms. Thus, the examples provided should not be construed to limit the scope of the claims.

As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
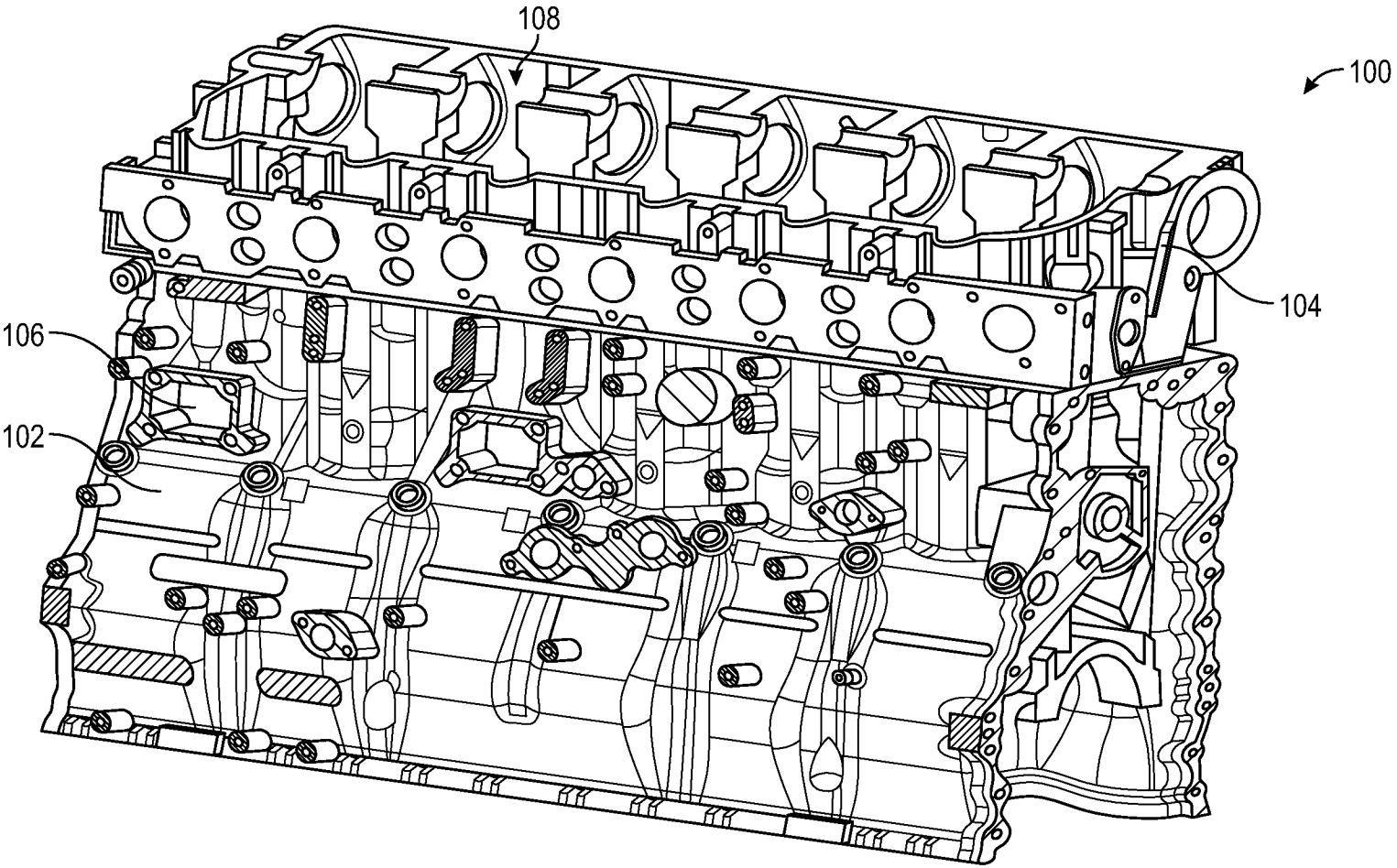
FIG. 1 is a perspective view of part of an engine block and a cylinder head of an example internal combustion engine with a portion of the cylinder head broken away to show part of a plurality of cylinder head jackets in accordance with an example of this disclosure.

FIG. 1 depicts parts of an internal combustion engine 100 (sometimes referred to as "engine" herein for simplicity) in accordance with this disclosure. The engine 100 can be used for power generation such as for the propulsion of vehicles or other machinery or for stationary power generation. The engine 100 can include various power generation platforms, and can use fuel including, for example, gasoline, gaseous fuel, diesel or blends thereof. Stationary engines may be used to drive immobile equipment, such as pumps, generators, mills, or factory equipment. It is understood that the present disclosure can apply to any number of piston-cylinder arrangements and a variety of engine configurations including, but not limited to, V-engines, inline engines, and horizontally opposed engines, as well as overhead cam and cam-in-block configurations. The internal combustion engine 100 can be used in stationary applications as discussed above but also can be used with vehicles and machinery that include those related to various industries, including, as examples, construction, agriculture, forestry, transportation, material handling, waste management, etc.

The engine 100 can include an engine block 102 and a cylinder head 104. Only portions of the engine block 102 and the cylinder head 104 are shown in FIG. 1. The cylinder head 104 can be mounted to the engine block 102. The engine block 102 can include a coolant inlet 106 and can define other features such as cylinders and jackets (not shown) that will be further discussed subsequently herein. The cylinders can define combustion chambers in which pistons reciprocate. The engine block 102, in particular regions around the cylinders, can be cooled by a coolant circulated through the engine block 102 and the cylinder head 104 from the coolant inlet 106 as further discussed herein.

The cylinder head 104 can form a housing for components such as fuel injectors. Each fuel injector can be in fluid communication with a respective combustion chamber and can be mounted in the cylinder head 104. The cylinder head 104 can include a plurality of cylinder head jackets 108 that can receive the coolant from the engine block 102 and/or a separate component or source. The cylinder head jackets 108 can be used to cool the fuel injectors and/or other components.

During operation of the engine 100, air enters the combustion chambers via intake valves. Air is able to enter the combustion chambers when the air intake valves are open, generally, during an intake stroke and/or at the end of an exhaust stroke and/or at the beginning of a compression stroke. When air is present in the combustion chambers, the fuel injectors can inject high pressure fuel as fuel jets. The fuel jets will generally disperse within the combustion chambers to create a fuel/air mixture within the combustion chambers. Ignition produces combustion, which, in turn, provides work on the pistons to produce motion upon the crankshaft to drive an output.

Figure 2:
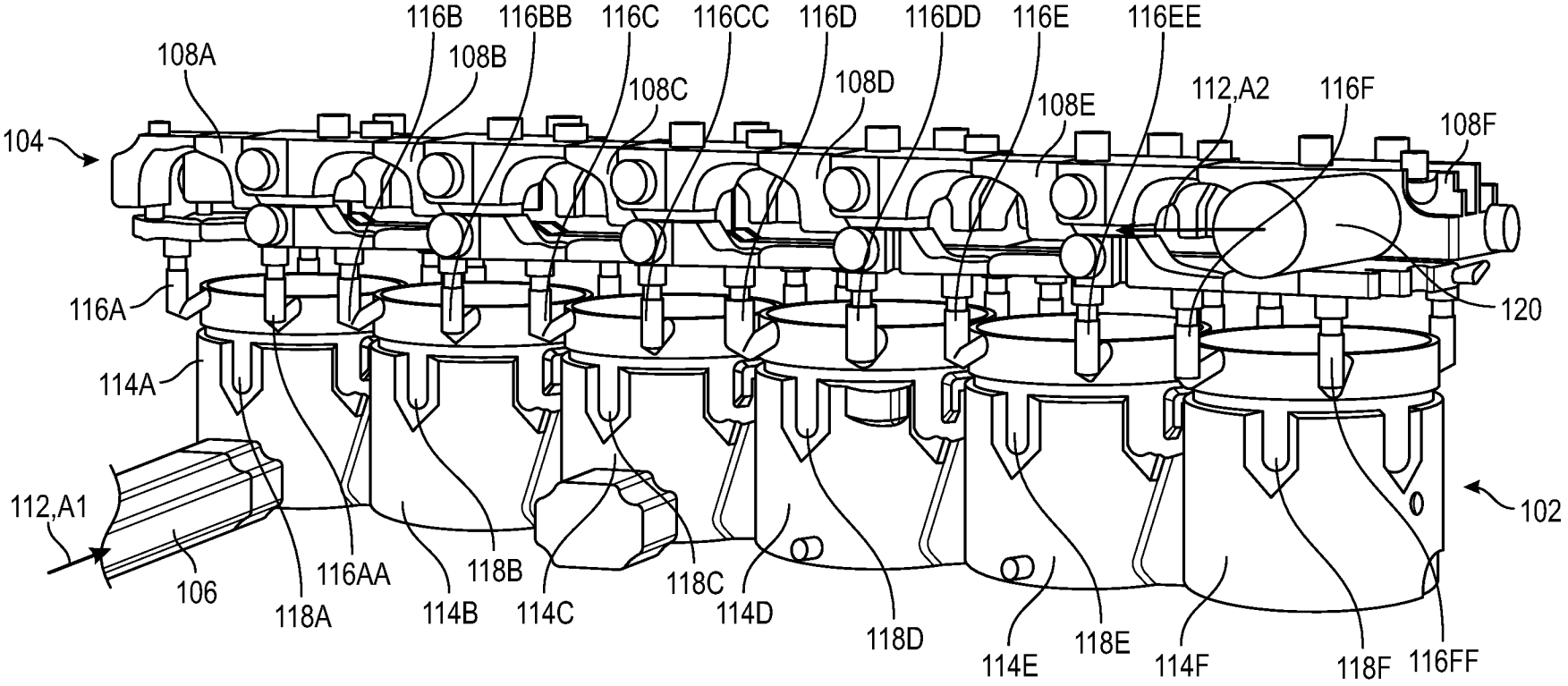
FIG. 2 is a perspective view of a coolant system for the engine block adjacent combustion cylinders including a plurality of cylinder jackets and lower cylinder head jackets in accordance with an example of this disclosure.

FIG. 2 shows portions of a coolant system 110 defined by the engine block 102 and the cylinder head 104. In FIG. 2, the housings of the engine block 102 and the cylinder head 104 are removed to show jackets, passages and other features of the engine block 102 and the cylinder head 104. Thus, the jackets and passages illustrated are cavities shown without the surrounding housings for ease of reference. FIG. 2 shows the coolant inlet 106 with coolant 112 shown entering in flow direction indicated with arrow A1. The engine block 102 includes a plurality of cylinder jackets 114A, 114B, 114C, 114D, 114E and 114F, passages 116A, 116AA, 116B, 116BB, 116C, 116CC, 116D, 116DD, 116E, 116EE, 116F and 116FF and cylinder liners 118A, 118B, 118C, 118D, 118E and 118F. Only some of the passages are numbered in FIG. 2. The cylinder head 104 can include a plurality of lower cylinder head jackets 108A, 108B, 108C, 108D, 108E and 108F. The plurality of lower cylinder head jackets 108A, 108B, 108C, 108D, 108E and 108F are parts of the plurality of cylinder head jackets 108 shown previously in FIG. 1.

The plurality of cylinder jackets 114A, 114B, 114C, 114D, 114E and 114F can surround all or parts of the cylinder liners 118A, 118B, 118C, 118D, 118E and 118F, respectively. As shown in FIG. 2, the passages 116A, 116AA, 116B, 116BB, 116C, 116CC, 116D, 116DD, 116E, 116EE, 116F and 116FF are in fluid communication with the plurality of cylinder jackets 114A, 114B, 114C, 114D, 114E and 114F and in fluid communication with the plurality of lower cylinder head jackets 108A, 108B, 108C, 108D, 108E and 108F. The passages 116A, 116AA, 116B, 116BB, 116C, 116CC, 116D, 116DD, 116E, 116EE, 116F and 116FF provide for flow paths between the plurality of lower cylinder head jackets 108A, 108B, 108C, 108D, 108E and 108F and the plurality of cylinder jackets 114A, 114B, 114C, 114D, 114E and 114F. The plurality of cylinder jackets 114A, 114B, 114C, 114D, 114E and 114F can be in fluid communication in series as shown in subsequent FIGURES such as FIG. 4. The arrangement of FIG. 2, including the passages 116A, 116AA, 116B, 116BB, 116C, 116CC, 116D, 116DD, 116E, 116EE, 116F and 116FF, can allow the coolant 112 to flow from the engine block 102 to the cylinder head 104.

Figure 3:
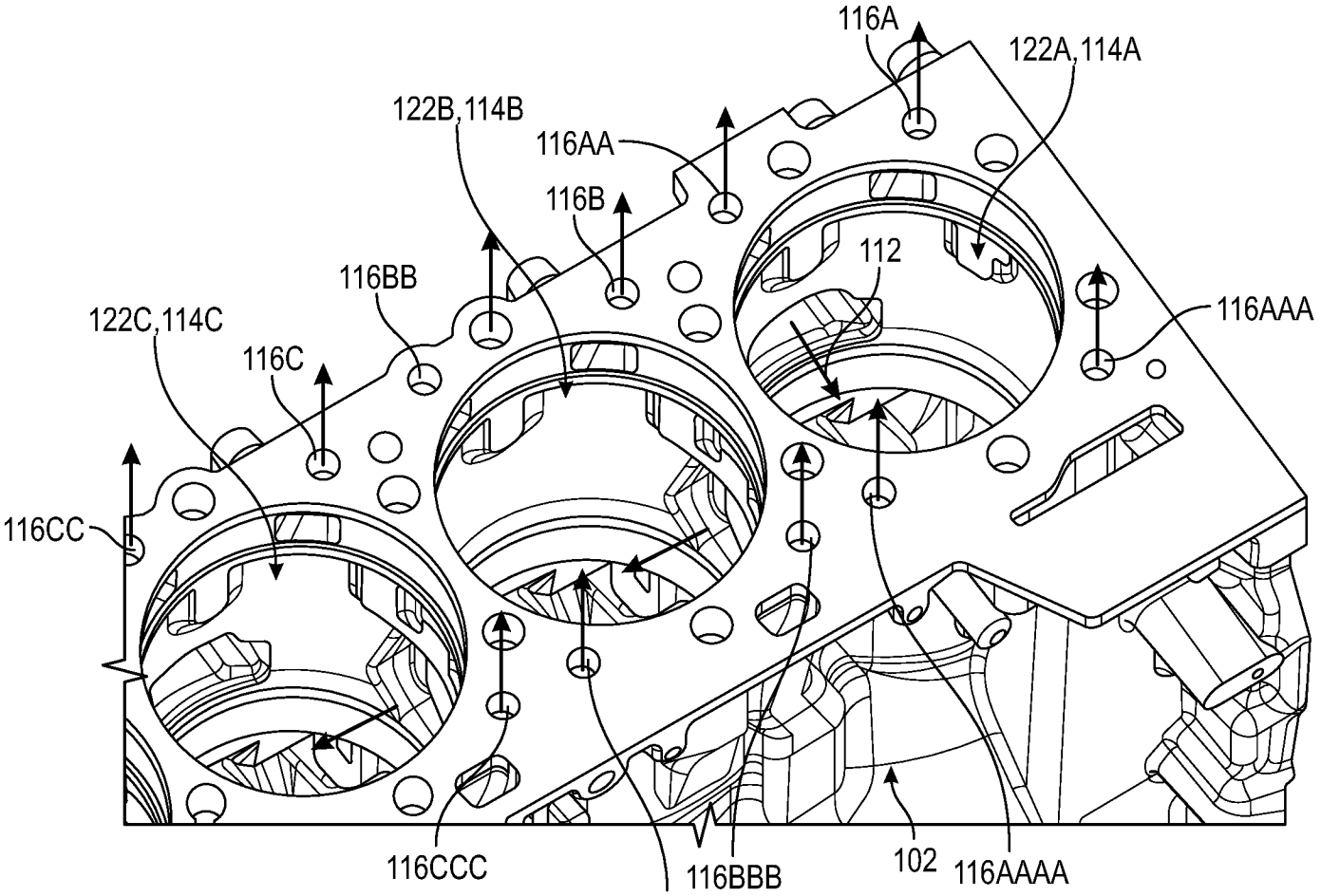
FIG. 3 is an elevated perspective view of a portion of the engine block with cylinder liners removed to show internally several of the plurality of cylinder jackets and the passages in accordance with an example of this disclosure.

As shown in FIG. 3, the plurality of cylinder jackets 114A, 114B, 114C, 114D, 114E and 114F can be arranged inline in series. The coolant inlet 106 is in fluid communication with the first cylinder jacket 114A. The passages 116A, 116AA (and optionally further passages not specifically numbered) can extend from the first jacket 114A to the first lower cylinder head jacket 108A. The first cylinder jacket 114A can be in fluid communication with the second cylinder jacket 114B. Similarly, the passages 116B, 116BB (and optionally further passages not specifically numbered) can extend from the second jacket 114B to the second lower cylinder head jacket 108B. The second cylinder jacket 114B can be in fluid communication with the third cylinder jacket 114C. The passages 116C, 116CC (and optionally further passages not specifically numbered) can extend from the third jacket 114C to the third lower cylinder head jacket 108C. The third cylinder jacket 114C can be in fluid communication with the fourth cylinder jacket 114D. The passages 116D, 116DD (and optionally further passages not specifically numbered) can extend from the fourth jacket 114D to the fourth lower cylinder head jacket 108D. The fourth cylinder jacket 114D can be in fluid communication with the fifth cylinder jacket 114E. The passages 116EE, 116EE (and optionally further passages not specifically numbered) can extend from the fifth jacket 114E to the fifth lower cylinder head jacket 108E. The fifth cylinder jacket 114E can be in fluid communication with the sixth cylinder jacket 114F. The passages 116F, 116FF (and optionally further passages not specifically numbered) can extend from the sixth jacket 114F to the sixth lower cylinder head jacket 108F. The sixth lower cylinder head jacket 108F can be in fluid communication with a coolant outlet 120 with the coolant 112 exiting therefrom with a flow direction indicated by arrow A2.

The terms "passage", "passages" as used herein should be interpreted broadly. These terms can be features defined by the engine block, the cylinder head, the combination of both the engine block and cylinder head, intermediate components between the engine block and the cylinder head such as seals, gaskets, etc. can also partially form the passage or passages. The term passage or passages as used herein can include not just jackets, cavities or manifolds but dedicated flow components such as fittings, hose, tube, pipe, etc. as known in the art.

Passages 116A, 116AA, 116B, 116BB 116C, 116CC, 116E, 116EE, 116F and 116FF can have a diameter that is substantially the same, for example. However, it is understood that in some cases the diameters of the passages 116A, 116AA, 116B, 116BB 116C, 116CC, 116E, 116EE, 116F and 116FF can differ. Such difference can be an intentional difference as dictated by design specification or can be due to tolerance, for example. The diameter of the passages 116D, 116DD can differ from those of the other passages 116A, 116AA, 116B, 116BB 116C, 116CC, 116E, 116EE, 116F and 116FF as further discussed below. Such difference in the diameter can be intentional.

Figure 2A:
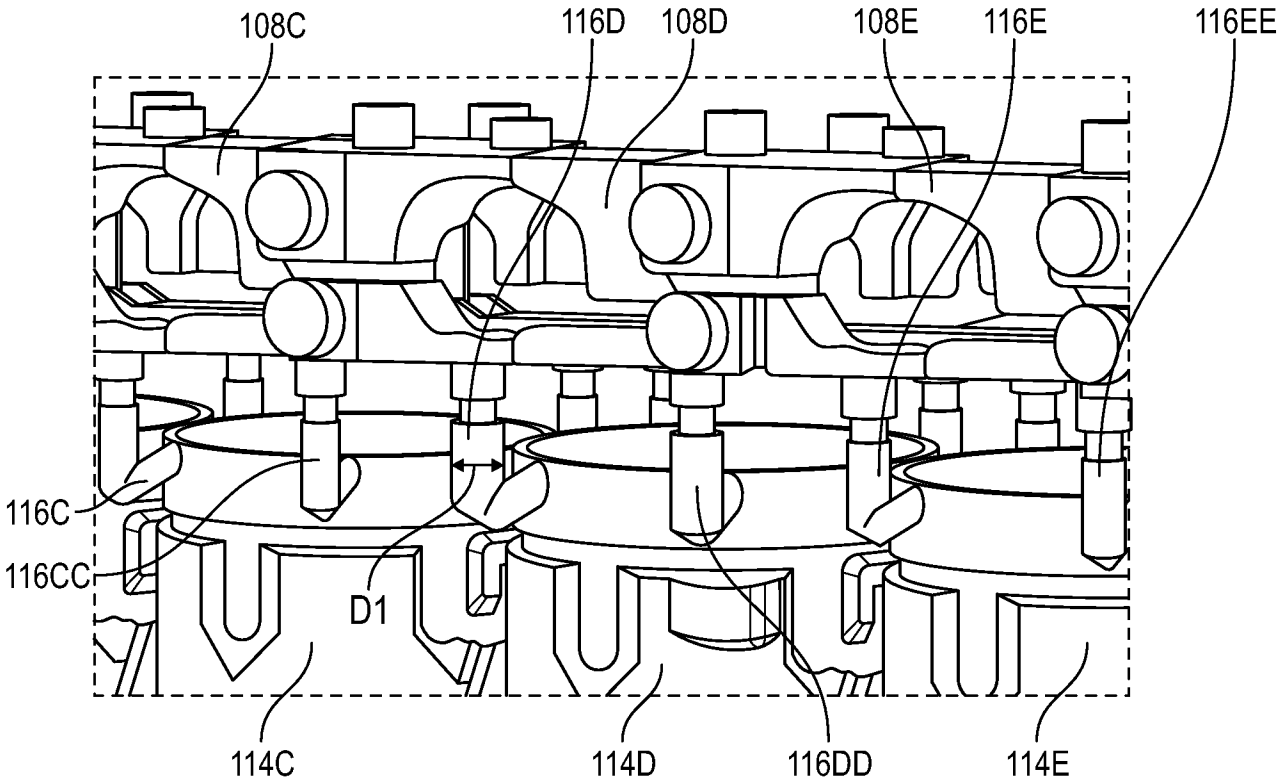
FIG. 2A is an enlarged view of several of the plurality of cylinder jackets and several of the plurality of cylinder head jackets of FIG. 2 showing differences in the passages therebetween.

FIG. 2A shows an enlarged view of the fourth cylinder jacket 114D, passages 116D, 116DD and the fourth lower cylinder head jacket 108D. As shown in FIG. 2A, the passages 116D, 116D can have diameters D1 that differ from the diameters of the other passages 116A, 116AA, 116B, 116BB 116C, 116CC, 116E, 116EE, 116F and 116FF (some shown in FIG. 2). FIG. 2A illustrates this difference in the size of the passages 116D, 116D, in particular the diameter D1, relative to the diameter of adjacent passages 116C, 116CC, 116E and 116EE. As shown in FIG. 2A the diameter D1 is relatively larger than the diameters of the other passages (here shown relative to the passages 116C, 116CC, 116E and 116EE). The difference in the diameter of the passages 116D, 116D is intentional as dictated by design specification and does not overlap with the diameters of the other passages 116A, 116AA, 116B, 116BB 116C, 116CC, 116E, 116EE, 116F and 116FF (some shown in FIG. 2).

As an example, the diameter D1 of the passages 116D, 116D can be between 265% and 113%, inclusive, larger in size than the diameters of the other passages 116A, 116AA, 116B, 116BB 116C, 116CC, 116E, 116EE, 116F and 116FF (some shown in FIG. 2). Put another way, the diameters of other passages 116A, 116AA, 116B, 116BB 116C, 116CC, 116E, 116EE, 116F and 116FF can be between about 88% and about 38% smaller than the diameter of the passages 116D, 116D.

FIG. 3 shows a portion of the engine block 102 with the cylinder liners removed. This removal allows view of some of cylinders 122A, 122B and 122C of the engine block 102 with some of the plurality of cylinder jackets 114A, 114B and 114C surrounding the cylinders 122A, 122B and 122C, respectively. Additionally, FIG. 3 shows with arrows flow of the coolant 112 through the engine block 102 via the plurality of cylinder jackets 114A, 114B and 114C and flow of the coolant 112 to the cylinder head (not shown) via the passages 116A, 116AA, 116B, 116BB 116C and 116CC. Additional passages 116AAA, 116AAAA, 116BBB, 116BBBB, 116CCC and 116CCCC are also utilized to provide the coolant 112 flow to (or in some examples from) the cylinder head (not shown). Indeed, the passages 116AAA, 116AAAA, 116BBB, 116BBBB, 116CCC and 116CCCC can provide outlets for the coolant from the cylinder head (not shown) back to the engine block 102 in some examples. However, the example of FIG. 3 shows the passages 116AAA, 116AAAA, 116BBB, 116BBBB, 116CCC and 116CCCC as outlets from the engine block 102 to the cylinder head (not shown).

Figure 4:
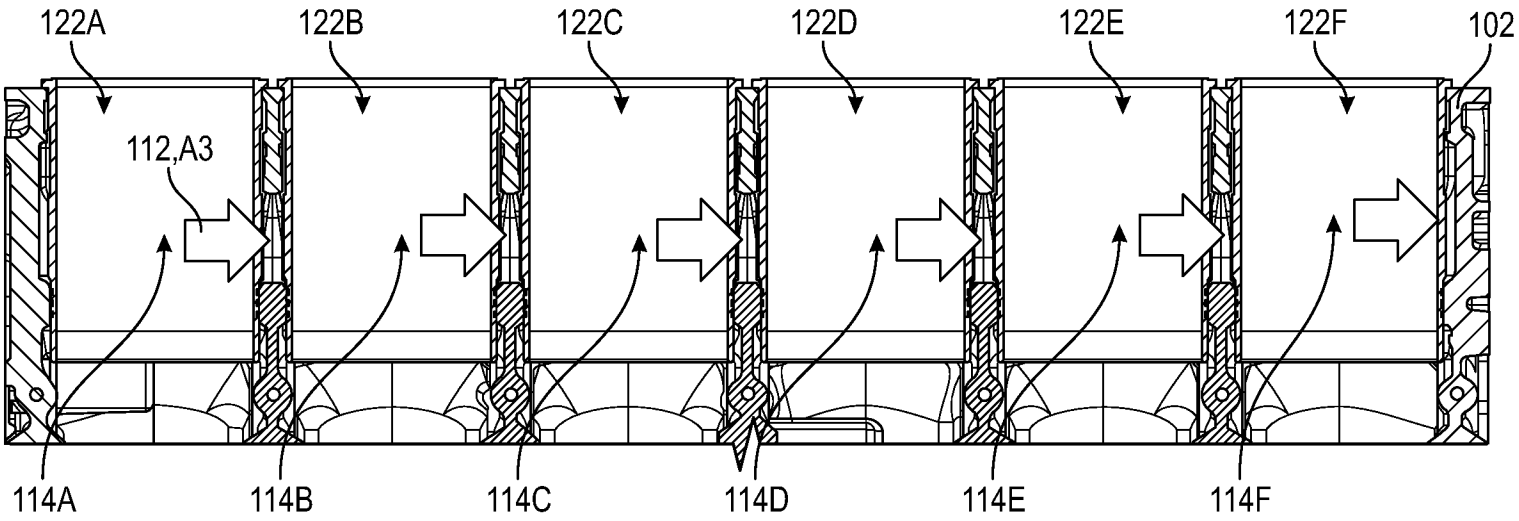
FIG. 4 is a cross-sectional view of the engine block showing fluid communication of the plurality of cylinder jackets in series in accordance with an example of the present application.

FIG. 4 shows a cross-section of part of the engine block 102 with the cylinders 122A, 122B, 122C, 122D, 122E and 122F and the plurality of cylinder jackets 114A, 114B, 114C, 114D, 114E and 114F. FIG. 4 illustrates flow of the coolant 112 as indicated with arrows A3 through the engine block 102 in series through the plurality of cylinder jackets 114A, 114B, 114C, 114D, 114E and 114F traveling from the first cylinder jacket 114A through to the sixth cylinder jacket 114F.

Figure 5:
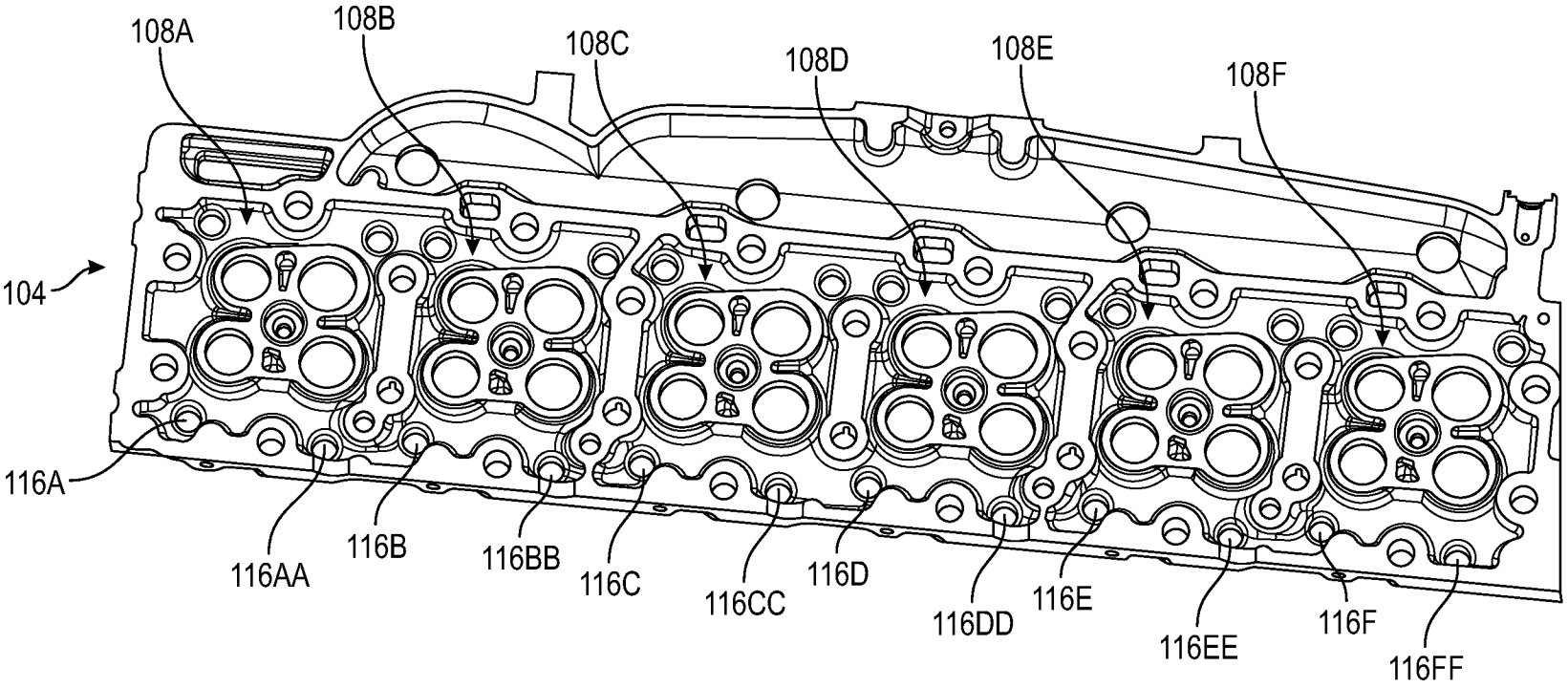
FIG. 5 is a cross-sectional view of the cylinder head showing the plurality of lower cylinder head jackets in accordance with an example of this disclosure.

FIG. 5 is a cross-section of the cylinder head 104 showing the plurality of lower cylinder head jackets 108A, 108B, 108C, 108D, 108E and 108F. FIG. 5 additionally shows the passages 116A, 116AA, 116B, 116BB, 116C, 116CC, 116D, 116DD, 116E, 116EE, 116F and 116FF (and additional passages not specifically number) which can be at least partially formed by the cylinder head 104. As discussed in regard to FIG. 3, some of the additional passages in some examples can provide for flow from the cylinder head 104 back to the engine block 102 (FIG. 4). As shown in FIG. 5, the first lower cylinder head jacket 108A can be in fluid communication with the second lower cylinder head jacket 108B in series. However, the second lower cylinder head jacket 108B is not in fluid communication with the third cylinder head jacket 108C. The third cylinder head jacket 108C can be in fluid communication with the fourth lower cylinder head jacket 108D in series. However, the fourth lower cylinder head jacket 108D is not in fluid communication with the fifth cylinder head jacket 108E. The fifth cylinder head jacket 108E can be in fluid communication with the sixth lower cylinder head jacket 108F in series. The sixth lower cylinder head jacket 108F can communicate with the outlet (not shown) for the coolant.

It is contemplated that in some examples the cylinder head 104 can be configured such that the plurality of lower cylinder head jackets 108A, 108B, 108C, 108D, 108E and 108F can all be in fluid communication in series in the manner of the plurality of cylinder jackets 114A, 114B, 114C, 114D, 114E and 114F of FIG. 4. Other examples of the cylinder head 104 contemplate more than two of the plurality of lower cylinder head jackets 108A, 108B, 108C, 108D, 108E and 108F can be in fluid communication. Yet further examples of the cylinder head 104 can be configured such that the plurality of lower cylinder head jackets 108A, 108B, 108C, 108D, 108E and 108F are not in fluid communication in series with one another. Although the present examples are described in reference to six cylinders 122A, 122B, 122C, 122D, 122E and 122F, other examples contemplate the use of more or less cylinders. Further examples also contemplate a different engine block arrangement than the inline cylinder arrangement discussed herein.

INDUSTRIAL APPLICABILITY

In operation, the engine 100 can be configured to combust fuel to generate power. Certain portions of the engine 100 including portions the engine block 102 and the cylinder head 104 adjacent the cylinders 122A, 122B, 122C, 122D, 122E and 122F where combustion takes place require cooling. The present disclosure contemplates the coolant system 110 can be in fluid communication with the engine block 102 and the cylinder head 104 and can supply coolant to jackets such as the plurality of cylinder jackets 114A, 114B, 114C, 114D, 114E and 114F and the plurality of lower cylinder head jackets 108A, 108B, 108C, 108D, 108E and 108F adjacent the cylinders 122A, 122B, 122C, 122D, 122E and 122F. The coolant supplied to the engine block 102 and the cylinder head 104 can have a desired temperature range, a desired pressure range and a desired mass flow rate range to provide sufficient desired cooling.

Figure 6:
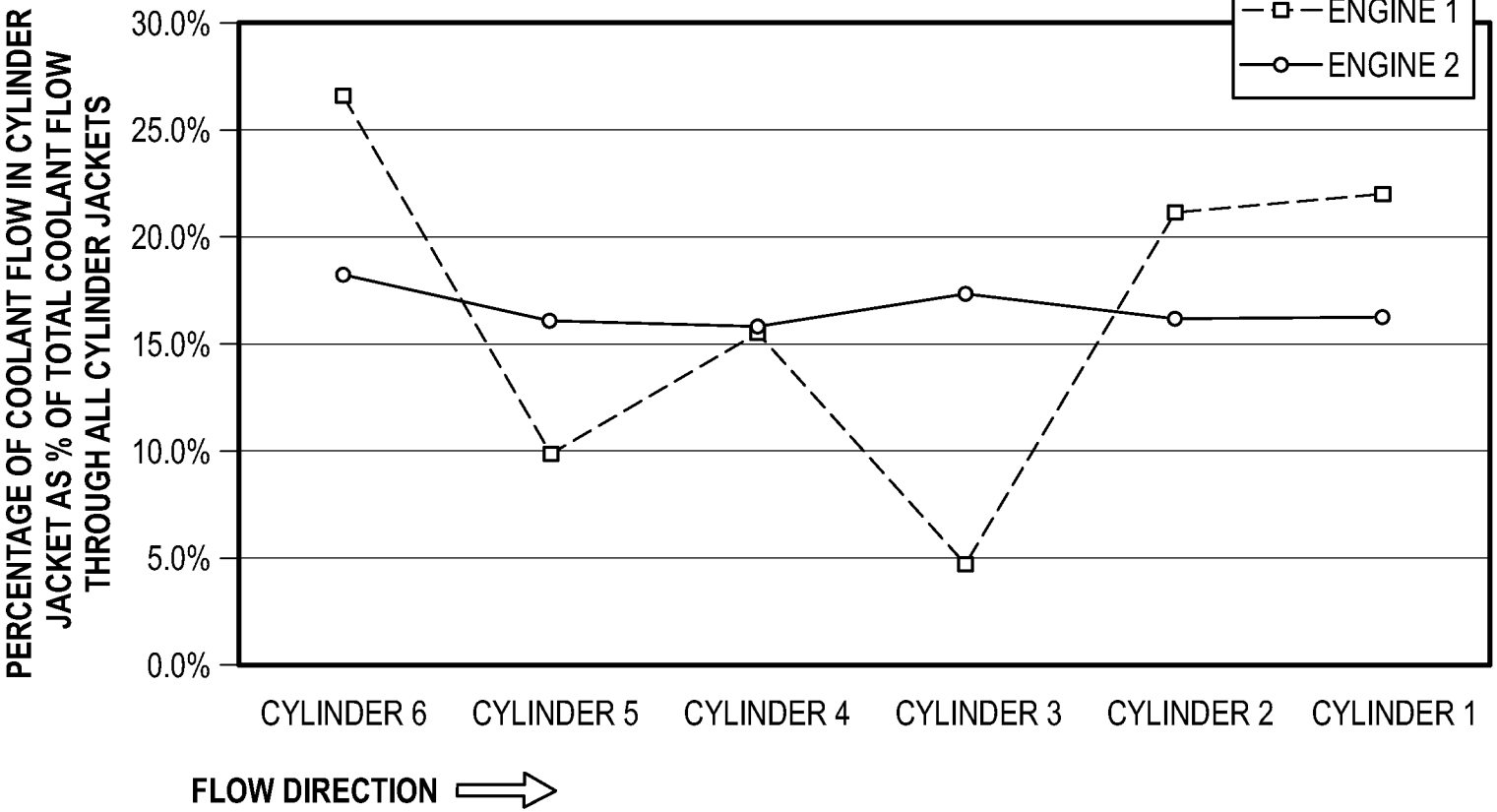
FIG. 6 is a chart showing coolant flow to the lower cylinder head jackets of a first internal combustion engine and a second internal combustion engine with the second internal combustion engine having improvements discussed herein in accordance with an example of this disclosure.

For clarity and understanding reference numbers used for the components of the engine 100 previously described in reference to FIGS. 1-5 will be used with discussion of Engine 1 and Engine 2 of FIG. 6. It should be understood, however, that Engine 1 does not include the passages configured in the manner discussed in FIGS. 2 and 2A, while Engine 2 does have such configuration for the passages. Studies by the present inventors have found that coolant flow through the plurality of cylinder jackets 114A, 114B, 114C, 114D, 114E and 114F and the plurality of lower cylinder head jackets 108A, 108B, 108C, 108D, 108E and 108F can be fairly non-uniform. This non-uniformity of coolant flow is shown with regard to Engine 1 for the plurality of lower cylinder head jackets 108A, 108B, 108C, 108D, 108E and 108F in the chart of FIG. 6. Engine 1 has a six cylinder in-line design similar to that of the engine 100 of FIGS. 1-5 but includes passages between the cylinder jackets and lower cylinder head jackets that all have substantially a same diameter.

As shown in FIG. 6 for Engine 1, the lower cylinder head jacket 108A for cylinder 6, which is adjacent the coolant inlet that communicates with the cylinder jacket 114A, receives a relatively largest percentage of coolant flow of all the plurality of lower cylinder head jackets 108A, 108B, 108C, 108D, 108E and 108F during stable coolant system operation. The lower cylinder head jacket 108B for cylinder 5 has a reduced flow percentage (about 10%) as compared with the lower cylinder head jacket 108A and the lower cylinder head jackets 108C, 108E and 108F. However, the lower cylinder head jacket 108D for cylinder 3 (the fourth cylinder from the coolant inlet) has the lowest coolant flow percentage (about 5%) as compared with the lower cylinder head jackets 108A, 108B, 108C, 108E and 108F.

It is understood by the present inventors that the first lower cylinder head jacket 108A has the highest flow rate (and hence largest percentage of flow as shown in FIG. 6) because of the proximity to the coolant inlet port. The lower cylinder head jacket 108F is similarly high because of proximity to the outlet. The second lower cylinder head jackets 108B has a reduced flow thereto because of a relatively higher flow impedance with fluid communication to the lower cylinder head jacket 108B as compared with the flow impedance between the lower cylinder head jacket 108A and the cylinder jacket 114A. The amount of the coolant bypasses flowing into the lower cylinder head jackets 108A and 108B and instead flows to the plurality of cylinder jackets 114C, 114D, 114E and 114F in series flow as previously discussed. Coolant enters the lower cylinder head jacket 108C from the cylinder jacket 114C. Similarly, coolant enters the lower cylinder head jacket 108D from the cylinder jacket 114D, and from the lower cylinder head jacket 108C, which can be in fluid communication in series with the lower cylinder head jacket 108D. The fourth of the plurality of lower cylinder head jacket 108D has a reduced flow thereto because of a relatively higher flow impedance with fluid communication to the lower cylinder head jacket 108D as compared with the flow impedance between the lower cylinder head jacket 108C and the cylinder jacket 114C.

FIG. 6 shows Engine 2 with the change to the diameter D1 of the passages 116D, 116DD as discussed in FIG. 2A and shows resulting flow percentages to the plurality of lower cylinder head jackets 108A, 108B, 108C, 108D, 108E and 108F are substantially more uniform (in a range between 18% and 16% per lower cylinder head jacket) as compared with those of Engine 1. The variance of the flow distribution of Engine 2 is 2% as compared with a variance of the flow distribution for Engine 1 of 20%. Reduction in this variance can improve flow circulation and reduce the potential for overheating of parts of the cylinder head 104 and/or the engine block 102 due to flow non-uniformity.

The inventors also recognize further benefits of the modification of the passages 116D, 116DD can include a reduced head lift for the engine 100. As used herein the term "head lift" is a measured separation or displacement of a bottom deck surface of the cylinder head 104 from a top deck of the engine block 102 at the perimeter as a result of thermal distortion and peak cylinder pressure in a given lateral plane of the engine.

Figure 7:
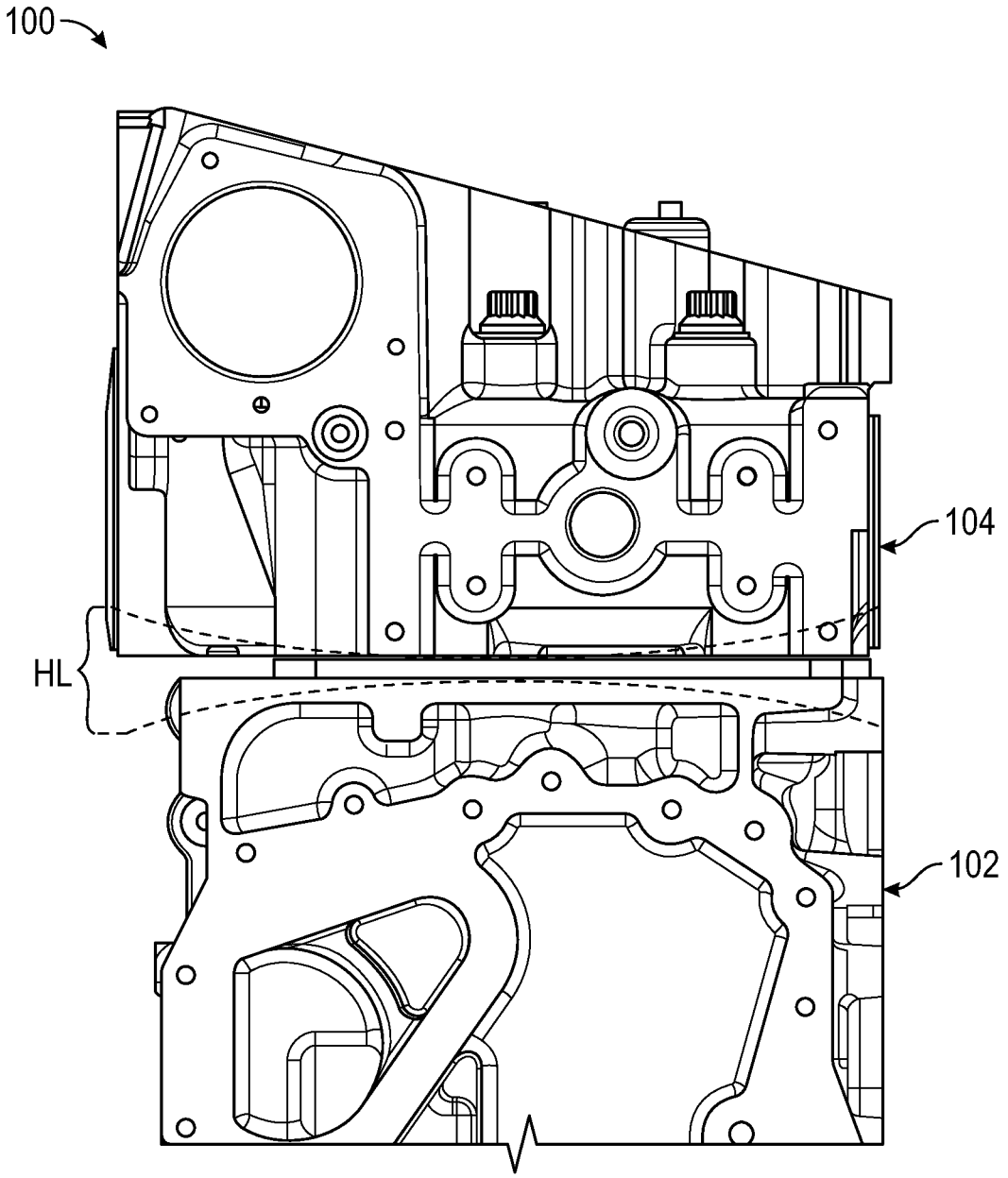
FIG. 7 is a cross-sectional view of the engine block and cylinder head showing a portion of an interface between the engine block and the cylinder head in accordance with an example of this disclosure.

FIG. 7 visibly illustrates head lift HL between the engine block 102 and the cylinder head 104 for the engine 100. Larger amounts of head lift can result in a loss of sealing pressure on shim gasket beads or other sealing structures, resulting in coolant leak(s) between the engine block 102 and the cylinder head 104.

Figure 8:
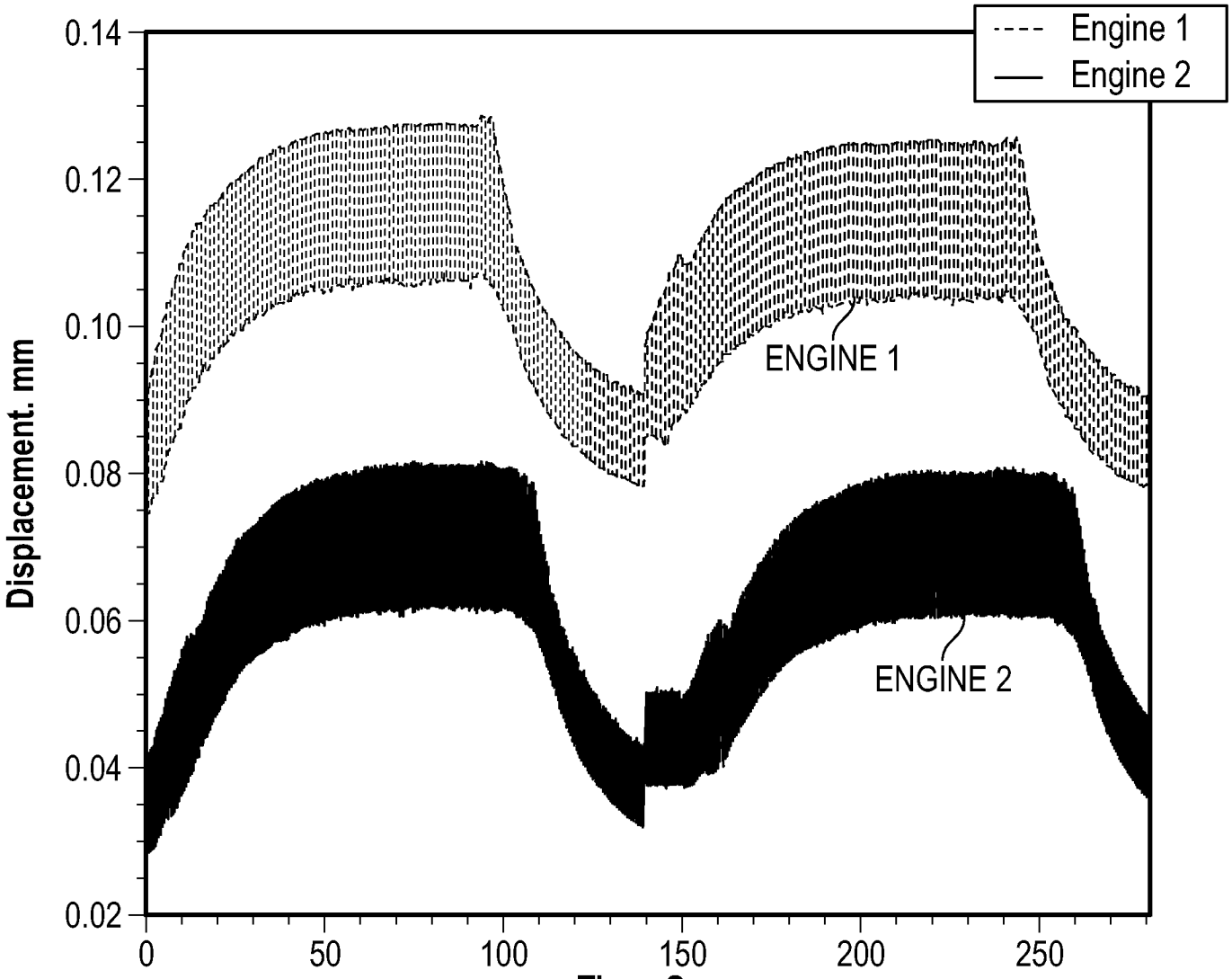
FIG. 8 are charts showing a reduction of head lift between the second internal combustion engine and the first internal combustion engine of FIG. 6 in accordance with an example of this disclosure.

FIG. 8 illustrates head lift of Engine 1 of FIG. 6 as compared with head lift of Engine 2 of FIG. 6 through an exemplary engine cycle. Engine 2 exhibits a reduction in head lift particularly for high lift cylinders 2, 3 and 5 (see FIG. 6). As shown in FIG. 8, up to a 40% reduction in head lift is seen on cylinder 2 of Engine 2 as compared with Engine 1.

The above detailed description is intended to be illustrative, and not restrictive. The scope of the disclosure should, therefore, be determined with references to the appended claims, along with the full scope of equivalents to which such claims are entitled.

What is claimed is:

1. An internal combustion engine comprising:

an engine block defining an inlet passage and defining a plurality of cylinder jackets surrounding respective cylinders and arranged in fluid communication in series such that coolant flows sequentially from a first cylinder jacket through each subsequent cylinder jacket, wherein the engine block further defines one or more passages from each of the plurality of cylinder jackets; and a cylinder head mounted to the engine block, the cylinder head defining an outlet passage and defining a plurality of discrete lower cylinder head jackets, wherein the one or more passages from each of the plurality of cylinder jackets are in direct fluid communication with a corresponding one of the plurality of lower cylinder head jackets in a one-to-one correspondence;

wherein a diameter of the one or more passages in fluid communication with one of the plurality of cylinder jackets differs from diameters of the one or more passages in fluid communication with others of the plurality of cylinder jackets; and wherein the diameters of the one or more passages in fluid communication with the others of the plurality of cylinder jackets are substantially the same.

2. The internal combustion engine of claim 1, wherein the plurality of cylinder jackets comprise six cylinder jackets, and wherein a fourth of the six cylinder jackets from the inlet passage has the one or more passages with the diameter that differs.

3. The internal combustion engine of claim 1, wherein the diameters of the one or more passages in fluid communication with the others of the plurality of cylinder jackets are smaller than the diameter of the one or more passages in fluid communication with the one of the plurality of cylinder jackets.

4. The internal combustion engine of claim 3, wherein the diameters of the one or more passages in fluid communication with the others of the plurality of cylinder jackets are 88% or less of the diameter of the one or more passages in fluid communication with the one of the plurality of cylinder jackets.

5. The internal combustion engine of claim 1, wherein the one or more passages comprise four passages between each of the plurality of cylinder jackets and each of the plurality of lower cylinder head jackets.

6. The internal combustion engine of claim 1, wherein two or more of the plurality of lower cylinder head jackets are in fluid communication with one another in series.

7. The internal combustion engine of claim 1, wherein no more than two of the plurality of lower cylinder head jackets are in fluid communication with one another in series.

8. A cooling system for an internal combustion engine comprising:

a plurality of cylinder jackets formed by an engine block, the plurality of cylinder jackets surrounding respective cylinders and arranged in fluid communication in series such that coolant flows sequentially from a first cylinder jacket through each subsequent cylinder jacket;

a plurality of discrete lower cylinder head jackets formed by a cylinder head; and a plurality of passages in fluid communication with the plurality of cylinder jackets and the plurality of lower cylinder head jackets, wherein the plurality of passages from each of the plurality of cylinder jackets that are in direct fluid communication with a corresponding one of the plurality of lower cylinder head jackets in a one-to-one correspondence, wherein a diameter of each of the plurality of passages in fluid communication with one of the plurality of cylinder jackets differ from diameters of the plurality of passages in fluid communication with others of the plurality of cylinder jackets, and wherein the diameters of the plurality of passages in fluid communication with others of the plurality of cylinder jackets are smaller than the diameter of each of the plurality of passages in fluid communication with one of the plurality of cylinder jackets.

9. The cooling system of claim 8, wherein the diameters of the plurality of passages in fluid communication with the others of the plurality of cylinder jackets are between 88% and 38% smaller than the diameter of the each of the plurality of passages in fluid communication with the one of the plurality of cylinder jackets.

10. The cooling system of claim 8, wherein the plurality of cylinder jackets comprise six cylinder jackets, and wherein a fourth of the six cylinder jackets from an inlet passage of the engine block has the plurality of passages with the diameter that differs.

11. The cooling system of claim 8, wherein two or more of the plurality of lower cylinder head jackets are in fluid communication with one another in series.

12. The cooling system of claim 8, wherein the plurality of passages comprise four passages between each of the plurality of cylinder jackets and each of the plurality of lower cylinder head jackets.

13. The cooling system of claim 8, wherein no more than two of the plurality of lower cylinder head jackets are in fluid communication with one another in series.

14. A method of metering coolant within between an engine block and a cylinder head of an internal combustion engine, the method comprising:

passing the coolant through an inlet of the engine block to into a first of a plurality of cylinder jackets formed by the engine block, wherein the plurality of cylinder jackets surround respective cylinders;

passing the coolant in series from the first of the plurality of cylinder jackets to others of the plurality of cylinder jackets such that coolant flows sequentially from the first of the plurality of cylinder jackets through each subsequent one of the plurality of cylinder jackets;

passing the coolant from the plurality of cylinder jackets to a plurality of lower cylinder head jackets formed by the cylinder head, wherein one or more passages from each of the plurality of cylinder jackets are in direct fluid communication with a corresponding one of the plurality of lower cylinder head jackets in a one-to-one correspondence, wherein the passing the coolant from one of the plurality of cylinder jackets to one of the plurality of lower cylinder head jackets is through the one or more passages having a larger diameter than the passing the coolant through the one or more passages from all others of the plurality of cylinder jackets to all others of the plurality of lower cylinder head jackets; and passing the coolant from an outlet of the cylinder head.

15. The method of claim 14, wherein the plurality of cylinder jackets comprise six cylinder jackets, and wherein the passing the coolant from the plurality of cylinder jackets to the plurality of lower cylinder head jackets formed by the cylinder head includes passing the coolant through the one or more passages with the larger diameter passages from a fourth of the six cylinder jackets in a flow path to a fourth of the plurality of lower cylinder head jackets.

16. The method of claim 14, wherein the one or more passages with the larger diameter are up to 265% larger than diameters of the one or more passages from all others of the plurality of cylinder jackets to all others of the plurality of lower cylinder head jackets.

17. The method of claim 14, wherein the one or more passages from the others of the plurality of cylinder jackets to the others of the plurality of lower cylinder head jackets have substantially a same diameter.

18. The method of claim 14, further comprising passing the coolant in series from at least one of the plurality of lower cylinder head jackets to another of the plurality of lower cylinder head jackets.

* * * * *